United States Patent [19]

Gilb

[11] 4,096,677

[45] Jun. 27, 1978

[54] POST BASE

[75] Inventor: Tyrell T. Gilb, Berkeley, Calif.

[73] Assignee: Simpson Manufacturing Co., Inc., San Leandro, Calif.

[21] Appl. No.: 805,638

[22] Filed: Jun. 13, 1977

[51] Int. Cl.[2] ..... E02D 27/00

[52] U.S. Cl. ..... 52/297; 61/53

[58] Field of Search ..... 113/116 F, 116 V, 116 HH, 113/116 Z; 29/150; 61/53; 52/165, 295, 297, 298, 722; 248/247, 248, 300; 312/263

[56] References Cited

U.S. PATENT DOCUMENTS

| | | | |
|---|---|---|---|
| 525,637 | 9/1894 | Wagandt | 113/116 V |
| 589,079 | 8/1897 | Glazier | 52/165 |
| 887,217 | 5/1908 | Oliphant | 52/295 |
| 1,544,863 | 7/1925 | Ross | 52/297 |
| 1,718,217 | 6/1929 | Crawford | 29/150 |
| 1,782,329 | 11/1930 | Webster | 113/116 F |

FOREIGN PATENT DOCUMENTS

| | | | |
|---|---|---|---|
| 19,235 | 10/1904 | Austria | 61/53 |

*Primary Examiner*—James L. Ridgill, Jr.
*Attorney, Agent, or Firm*—James R. Cypher

[57] ABSTRACT

A post base connection device for attachment to concrete to provide resistance to lateral and vertical movement of the post in respect to the concrete. The device is in essence a continuous V-section member which is bent at its mid-point and configured so that the bend mid-point and adjacent areas provide the concrete embedment portions with the upstanding legs thereof continuing upward to encapsulate diagonally opposed corners of the post.

4 Claims, 10 Drawing Figures

POST BASE

BACKGROUND OF THE INVENTION

The primary purpose of any post base is to provide bearing in respect to, and attachment to the supporting concrete. These primary functions have been provided by unpatented U-shaped metal straps in which the base was set in wet concrete and the wood posts were then nailed or bolted to the two vertical legs.

Post base improvements, also unpatented, have included devices for providing moisture separation between the end of the post and concrete by metal platforms or embedded pipe stems for elevating a separate U-shaped member above the concrete.

Patent activity in this art has been practically nonexistent. In 1959, Wood, U.S. Pat. No. 2,909,816 provided a post support device which was attachable to a heavy bolt embedded in the concrete. The Wood device provided some lateral relative resistance but practically no resistance to overturning forces.

The only significant improvement in post bases was provided by Gilb, U.S. D 215,727 in 1969. All of the primary functions were provided from a single piece of metal. The Gilb device, however, like the unpatented devices, was a U-shaped device and was attached to the post on two, opposite sides only.

The prior art devices are satisfactory for post or column purposes when the top of the post or column is affixed to structure such as a roof and other means are provided for lateral bracing. None of the prior art devices, however, provide significant moment resistance if the function of the post or column is intended for use in a free standing configuration, such as a fence post. This deficiency has seriously limited the use of such devices for posts associated with fences and other free-standing structures wherein lateral movement resistance cannot be provided in all directions in respect to the post. From examination of these devices, it is evident that at best only a minimum of moment resistance is given by two opposed upturned sides, while in the other direction the bolts or nails act only, for all practical purposes, as a pivot connection in respect to any significant movement forces.

One obvious solution to the problem of providing resistance to moment forces in all directions is to encapsulate the lower area of the post for a sufficient length upwards and extend a lower portion downward a sufficient distance into the concrete. Such a device would certainly create a rigid connector. On occasion, some designers, in desperation, have done just this as a solution to a problem when significant moment forces had to be resisted. Such a solution, however, is totally impractical due to the amount of metal it uses, the undesirable total moisture encapsulation of the lower portion of the post, and the undesirable and the practical jobsite difficulty of installing a post into a deep sleeve-like device. A slightly better version of this has been the use, on occasion, of two opposed U-channels encapsulating the lower portion of a post and extending downward into the concrete. This method is also deficient commercially, as it uses about four times the justified metal for accomplishment of the required purpose.

BRIEF SUMMARY OF THE INVENTION

The essence of the invention and the primary departure from the prior art is the use of a continuous V-section member which is bent at its mid-point and configured so that the bend mid-point and adjacent areas provide the concrete embeddment positions with the upstanding legs thereof continuing upward to encapsulate diagonally opposed corners of the post. This solution, in its simplest form, with a plurality of bolts or nails, is adequate but utilizes an excess of metal on at least one leg of the upturned section. About twice the amount of metal required, is used to resist the moment forces.

The second significant development was the recognition that the continuous V-section element could and should be fabricated by a progressive die means to provide the necessary metal configuration to provide a bolt pattern means of attachment while retaining only the required net section needed for moment resistance.

A related, but separate solution was required for the bearing plate. Although a simple flat plate could be welded into the inside angles of the V-section (and in fact may be done in some models), a preferred design is to provide a standoff type plate as a moisture barrier in accordance with code recommendations. An ideal solution is a four-legged standoff plate which uses the otherwise corner cut wasted material as a tab means of attachment at the center line of the upstanding legs of the device. This provides a rigid product in respect to the bearing plate, provides moisture protection, and eliminates welding.

The device presents a substantial savings for a given size in respect to similar prior art products. There is significantly less material, it is fabricated by automatic progressive dies, no welding is required, and the product may be fabricated from metal gauges within the galvanized sizes, thereby eliminating painting.

The device performs all of the functions of the prior art, but, in addition, the device provides substantial resistance to moment forces in all directions thereby providing a rigidity never before attained in such an inexpensive and lightweight device.

DESCRIPTION OF THE PREFERRED EMBODIMENTS OF THE INVENTION

Figure 1:
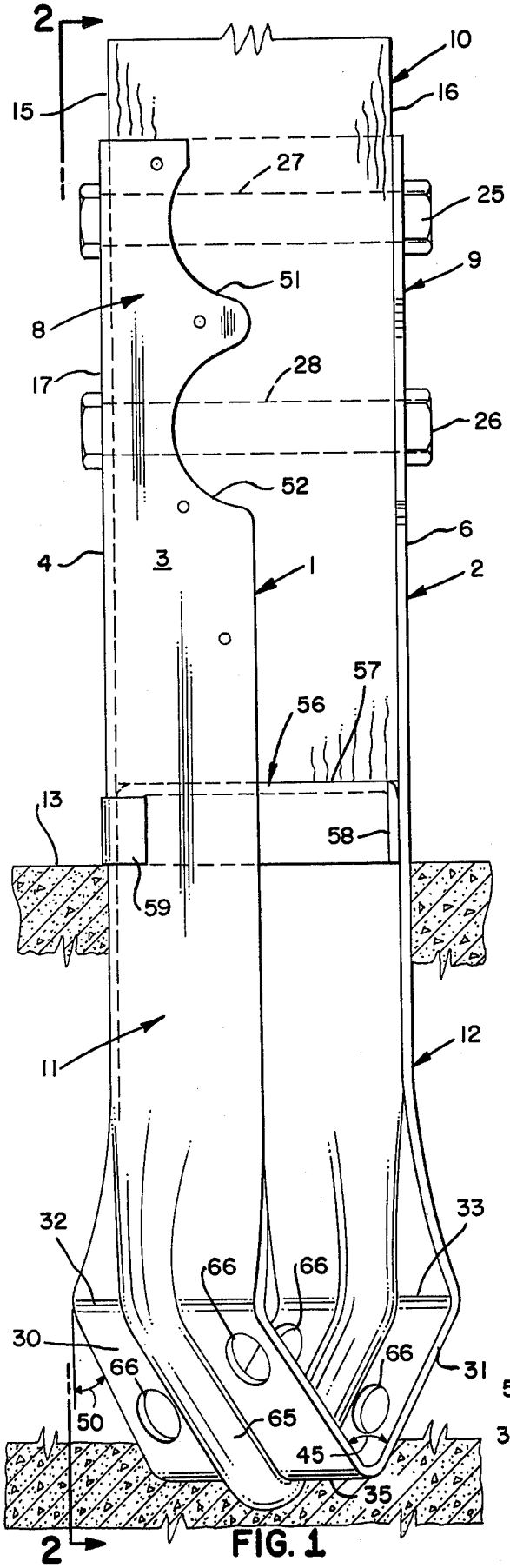
FIG. 1 is a side elevation view of the post base of the present invention. The device is illustrated showing a wood post and with the lower portion embedded in concrete.

The post base of the present invention consists of a pair of elongated metal angle members 1 and 2 each having a first and second side 3, 4, 5, and 6 and each having an upper portion 8 and 9 adapted for connection to a wood post 10 and a lower portion 11 and 12 adapted for embedment in concrete 13.

The angle members are arranged to receive opposite diagonal corners 15 and 16 of the post in the corners 17 and 18 of the angles. A plurality of openings 20, 21, 22, and 23 are formed in one side of each angle member in opposed relationship. The openings receive fasteners such as bolts 25 and 26 which are inserted through bore openings 27 and 28 in the post.

The base members 30 and 31 are connected to the lower ends of the angle members at an angle thereto along bend lines 32 and 33 and are embedded in the concrete.

In the preferred form of the invention, the base members are connected to one another along fold line 35 rather than being separate pieces. Construction of the device from a single sheetmetal member permits the device to be made on a progressive die machine, shipping and handling are simplified, and installation is easier.

As shown in the drawings, the preferred shape of the base of the post base is a V-shape so that the base may be more easily pressed into wet concrete for installation. The angle of the base members may be approximately 90°.

As previously stated, one of the significant developments was to recognize that a continuous V-shaped section could and should be fabricated by a progressive die means.

Figures 5, 6, 7:
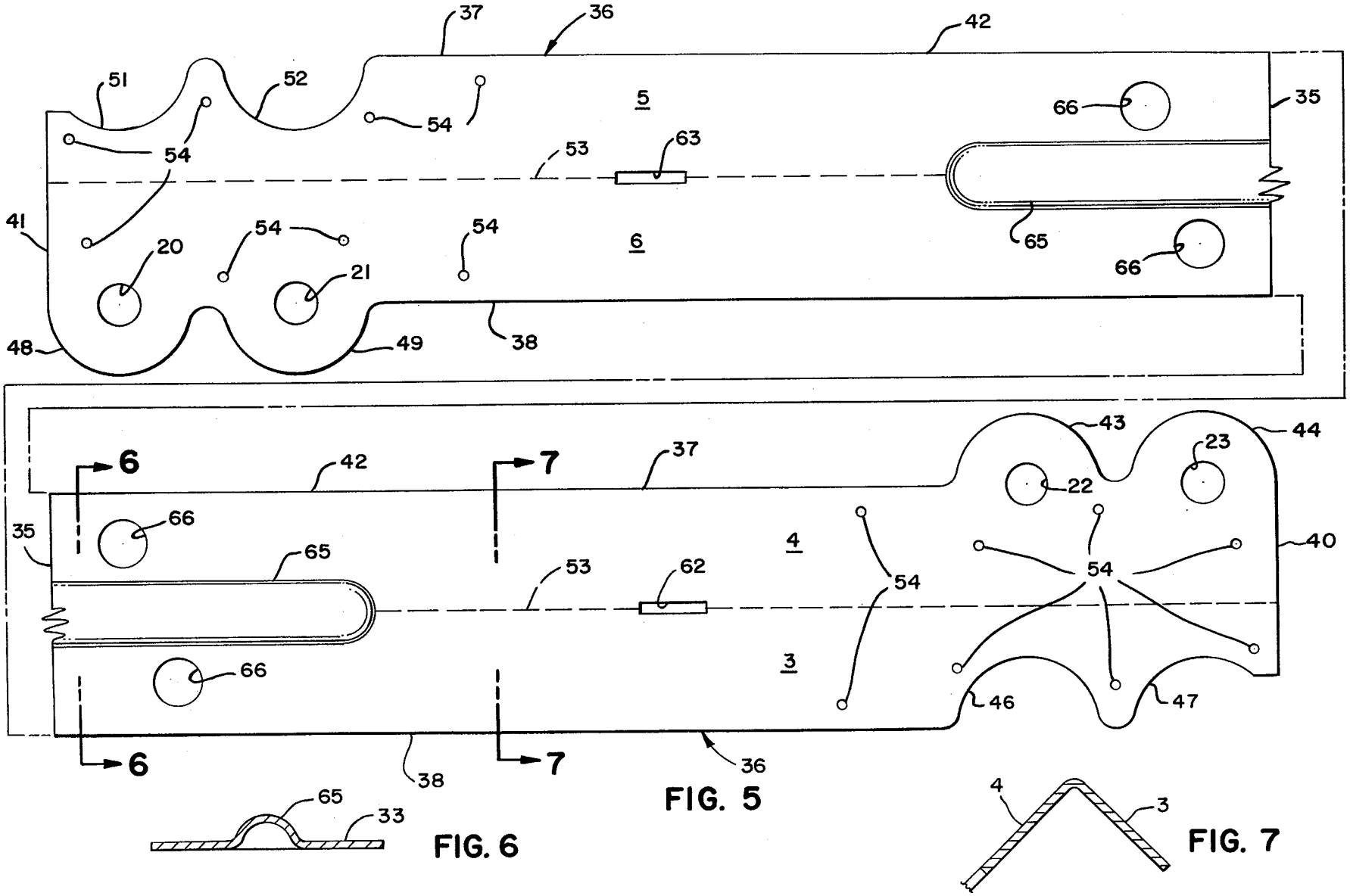
FIG. 5 is a top plan view of the post base blank prior to bending. The post base blank has been cut roughly in half by the illustrator for purposes of illustration. The halves are joined along the broken lines.
FIG. 6 is a cross-sectional view of the post base taken along line 6—6 of FIG. 5.
FIG. 7 is a cross-sectional view of the post base taken along line 7—7 of FIG. 5.

Referring to FIGS. 5–7, the post base is formed from a sheet of metal 36 having a length several times greater than its width. For purposes of identification, the metal strip has a leading edge 37, a trailing edge 38, a first end 40 and a second end 41. The mid-portion 42 is generally identified as the portion which is later embedded in the concrete, and at the end portions are later connected to a wood post. At least one and preferably two openings 22 and 23 are formed at the first end for receiving a fastener therethrough and the leading edge adjacent to each of the openings is formed with additional metal forming first projections 43 and 44. The trailing edge at the first end is formed with cut-out portions 46 and 47 of substantially equal size and configuration to the first projections.

Openings 20 and 21 may be formed in the trailing edge of the second end for receiving the other end of the fastener and additional metal adjacent the openings forms second projections 48 and 49. The leading edge at the second end may be formed with cut-out portions 51 and 52 equal in size and configuration to the second projections.

Figure 2:
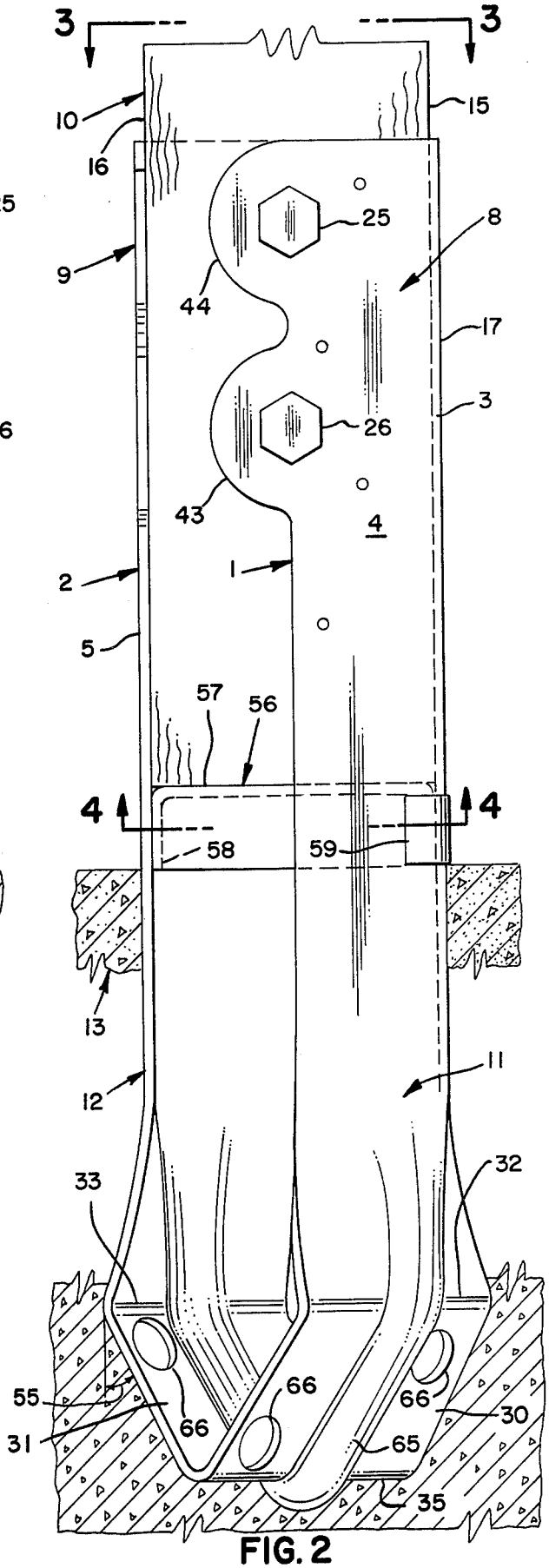
FIG. 2 is another side elevation view of the post base of FIG. 1 as viewed in the direction of arrows 2—2.
Figure 3:
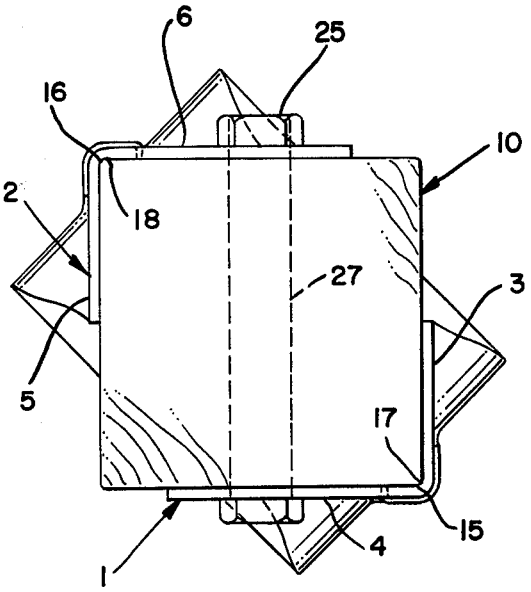
FIG. 3 is a top plan view of the post base of FIG. 1.
Figure 4:
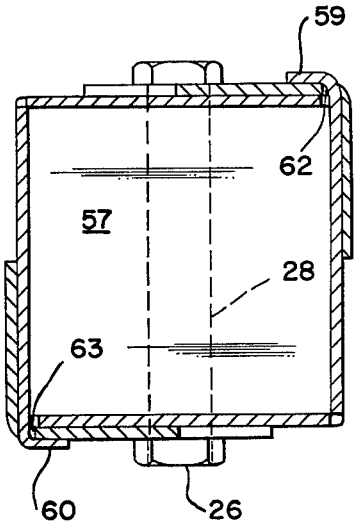
FIG. 4 is a cross-sectional view of the post base taken along line 4—4 of FIG. 2.
Figure 8:
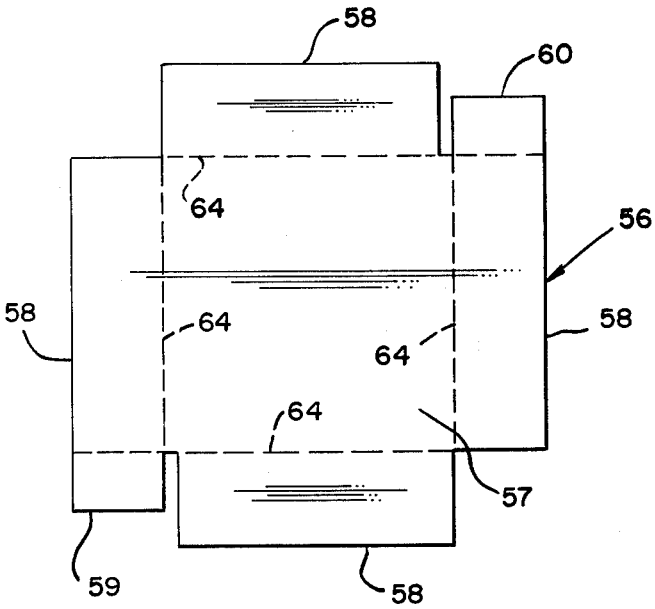
FIG. 8 is a plan view of a blank of the stand-off base prior to bending.
Figure 9:
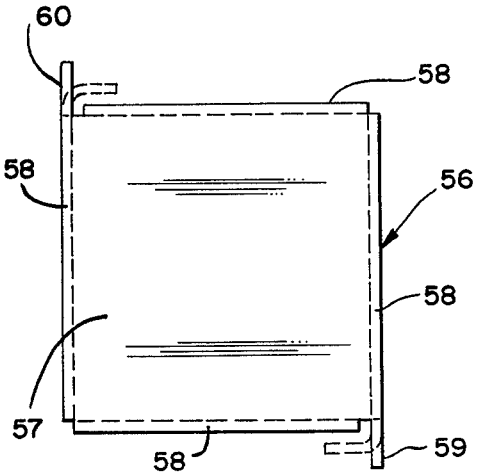
FIG. 9 is a top plan view of the stand-off base of FIG. 9 prior to assembly with the post base.
Figure 10:
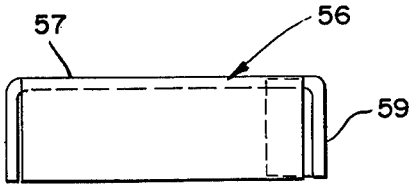
FIG. 10 is a side view of the stand-off base of FIG. 8 after folding and installation on the post base.

To form the post base, the strip of metal is folded at an approximately 90° angle designated by arrow 45 along a line 35 at its midpoint along the short side of the metal strip and is also folded at an approximately 45° angle designated by the arrows 50 and 55 in FIGS. 1 and 2 respectively along the short side along two lines 32 and 33 equidistant from the midpoint and parallel to the mid-point fold line. To form the angle members, the metal strip is folded at an approximately 90° angle at approximately the mid-point of the strip along the longer side of the strip along a fold line 53 from the two equidistant lines to the first and second ends.

If bolts are not used to connect the post base to the wood post, nail openings 54 may be formed in both ends. If nails are used, it would be necessary to form the projections and cut-out portions at each end. For commerical reasons, it is desirous to have both nail hole openings and bolt hole openings to reduce the number of inventory items necessary for distributors and to reduce manufacturing costs.

In order to provide a moisture barrier between the wood post and the concrete, a stand-off member 56 may be provided which consists of a base 57 and a plurality of legs 58 and a pair of tabs 59 and 60. These tabs are inserted through slots 62 and 63 formed in the angle members at the intersections of the side portions in the upper portions adjacent the lower portions. Waste metal is minimized by forming the tabs of the corner cut-outs of a flat piece of metal. The legs are folded along bend lines 64.

To strengthen and rigidize the base, an embossment 65 is formed therein. The embossment also helps to keep the angle members in alignment for ease in installation of the post.

To permit flow of wet concrete through the post base, openings 66 may be formed in the base.

The post base has been tested by an independent laboratory and the test results dramatically illustrate the breakthrough in the state of the art for a device of this purpose. The forma lab tests show that the device has an uplift value of 16,080 lbs. minimum. International Council of Building Officials (ICBO) uplift after taking into account safety factors is expected to be over 4,000 lbs. Internal testing has shown that the device has a resistance of approximately 3,000 foot-pounds in respect to over-turn in any direction. In practical terms, if this device were used in a fence, 6 feet high with posts 8 feet on center, and it were a solid sheeted type, then the erected fence would be capable of resisting approximately 60 pounds per square foot of wind pressure. The wind resistance requirement for such structures in the United States is governed by a table for different parts of the country which require wind resistance capabilities of between 15 pounds per square foot and up to 50 pounds per square foot. The latter requirement is in a limited area in the hurricane belt along the Gulf Coast. More realistically, California is either a 15 or 20 pound wind area. Furthermore, the text books advise that, tornadoes excepted, wind loads in excess of 40 pounds per square foot are unheard of. More importantly, the device value realistically equals and exeeds the limiting value of the post itself. The device value, with a safety factor, approximately equals the bending moment value of 4 × 4 post with a safety factor.

Typical structural details of a post base for use with a 4 × 4 post are as follows. The post base may be embedded into the concrete about 8 inches, the stand-off plate raises the post off the concrete about 1⅛ inches, and the post is supported to a height of about 8 inches. The material used is preferably 12 guage galvanized steel for the 4 × 4 model.

The length of the strip of metal may be 34½ inches with a width of 3½ inches. The bolt openings may be 21/32 inches in diameter and the projections may have a radius of 1 inch.

I claim:

1. A post base formed from a sheet metal comprising:

a. a strip of metal having a length several times greater than its width, and having a leading edge and a trailing edge, and having first and second ends;

b. said strip of metal consists of a mid-portion adapted for embedment in a concrete foundation and end portions adapted for connection to a wood post;

c. said metal strip adjacent said leading edge is formed with at least one opening at said first end for receiving a fastener therethrough and said leading edge adjacent to each of said openings is formed with additional metal forming a first projection and said trailing edge at said first end is formed with cut-out portions of substantially equal size and configuration to said first projections;

d. said metal strip adjacent said trailing edge at said second end is formed with at least one opening for receiving a fastener therethrough and said trailing edge adjacent to each of said openings is formed with additional metal forming a second projection;

e. said leading edge at said second end is formed with at least one cut-out portion which is substantially equal in size and configuration to said second projection.

f. said strip of metal is folded at an approximately 90° angle at its mid-point along the short side of said strip of metal and is folded at an approximately 45° angle along said short side along two lines equidistant from said mid-point and parallel to said mid-point fold line; and g. said strip of metal is folded at an approximately 90° angle at approximately the mid-point of said strip along the longer side of said strip from said two equidistant lines to said first and second ends forming angle members.

2. A post base as described in claim 1 comprising:

a. each of said angle members are formed with a slot on said 90° fold line immediately below said end portions and above said mid-portion which is embedded in said concrete;

b. a stand-off member having a base adapted for supporting the lower end of said wood post and a plurality of legs connected to said base and depending downwardly from said base and adapted for resting on the upper surface of said concrete foundation and a pair of tabs connected to said base for insertion through said slots; and c. said stand-off member is connected to said angle members by bending said tabs against the sides of said angle members.

3. A post base formed from a sheet of metal comprising:

a. a strip of metal having a length several times greater than its width, and having a leading edge and a trailing edge, and having first and second ends;

b. said strip of metal consists of a mid-portion adapted for embedment in concrete and end portions adapted for connection to a wood post;

c. said metal strip adjacent said leading and trailing edges at said first and second ends is formed with a plurality of openings adapted for receiving a plurality of fasteners therethrough;

d. said strip of metal is folded at an approximately 90° angle at its mid-point along the short side of said strip of metal and is folded at an approximately 45° angle along said short side along two lines equidistant from said mid-point and parallel to said mid-point fold line; and e. said strip of metal is folded at an approximately 90° angle at approximately the mid-point of said strip along the longer side of said strip from said two equidistant lines to said first and second ends forming angle members.

4. A post base as described in claim 3 comprising:

a. said angle members are formed with a slot on said 90° fold line immediately below said end portions and above said mid-portion which is embedded in said concrete;

b. a stand-off member having a base adapted for supporting the lower end of said wood post and a plurality of legs connected to said base and depending downwardly from said base and adapted for resting on the upper surface of said concrete foundation and a pair of tabs connected to said base for insertion through said slots; and c. a portion of said strip of metal in said mid-portion is formed with an embossment along the longitudinal axis for stiffening said member and is formed with a plurality of openings in said mid-portion adapted for passing wet concrete therethrough.

* * * * *